US008468661B2

(12) United States Patent
Brownlow et al.

(10) Patent No.: US 8,468,661 B2
(45) Date of Patent: Jun. 25, 2013

(54) LATCH FOR CASKET LID

(75) Inventors: John Brownlow, Grand Rapids, MI (US); Timothy D. Derengowski, Kentwood, MI (US); Ricky L. Eustice, Hamilton, MI (US)

(73) Assignee: Clarion Technologies, Inc., Holland, MI (US)

( * ) Notice: Subject to any disclaimer, the term of this patent is extended or adjusted under 35 U.S.C. 154(b) by 17 days.

(21) Appl. No.: 13/150,515

(22) Filed: Jun. 1, 2011

(65) Prior Publication Data

US 2011/0296655 A1 Dec. 8, 2011

Related U.S. Application Data

(60) Provisional application No. 61/350,746, filed on Jun. 2, 2010.

(51) Int. Cl.
*A61G 17/00* (2006.01)

(52) U.S. Cl.
USPC ..... 27/17; 27/DIG. 1; 292/150; 292/162; 292/302

(58) Field of Classification Search
USPC ..... 27/DIG. 1, 2, 14, 16, 17; 292/147, 292/157, 162, 302, 150; 403/322, 322.1, 403/321
See application file for complete search history.

(56) References Cited

U.S. PATENT DOCUMENTS

| | | | | |
|---|---|---|---|---|
| 493,096 | A * | 3/1893 | Kregel | 292/202 |
| 1,762,578 | A * | 6/1930 | Hiser | 27/17 |
| 2,323,674 | A * | 7/1943 | Purkiss | 292/157 |
| 2,582,841 | A * | 1/1952 | McEwan | 27/17 |
| 2,778,089 | A * | 1/1957 | Woltering | 27/17 |
| 3,521,920 | A * | 7/1970 | Morand | 292/39 |
| 3,570,082 | A * | 3/1971 | Gruber | 27/6 |
| 3,879,818 | A | 4/1975 | Rowland | |
| 4,800,631 | A | 1/1989 | Pellmann | |
| 5,966,786 | A * | 10/1999 | Bowling | 27/2 |
| 6,116,663 | A * | 9/2000 | Robert | 292/153 |
| 6,152,499 | A * | 11/2000 | Robert | 292/153 |
| 6,364,377 | B1 * | 4/2002 | Ferguson | 292/175 |
| D538,635 | S | 3/2007 | De La Fuente | |
| 7,434,298 | B2 | 10/2008 | De La Fuente | |
| 7,703,186 | B1 | 4/2010 | Williamson | |
| 7,730,595 | B2 | 6/2010 | De La Fuente | |
| 2010/0218350 | A1 | 9/2010 | De La Fuente | |
| 2011/0252612 | A1 | 10/2011 | Brownlow et al. | |

OTHER PUBLICATIONS

VertiCasket System Brochure, published at least as early as 2009.

* cited by examiner

*Primary Examiner* — William L. Miller
(74) *Attorney, Agent, or Firm* — Gardner, Linn, Burkhart & Flory, LLP

(57) ABSTRACT

A pin latch assembly for releasably securing a casket lid in a closed position includes a latch housing and inner latch member disposed along a side wall of the casket, and a pin member projecting from the casket lid. The latch housing and inner latch member each include a respective bore or through-hole for receiving the pin member when the lid is closed. The inner latch member is movable within the latch housing between a pin-engaging position and a pin-disengaging position.

19 Claims, 12 Drawing Sheets

LATCH FOR CASKET LID

CROSS REFERENCE TO RELATED APPLICATION

The present application claims the priority benefit of U.S. provisional application Ser. No. 61/350,746, filed Jun. 2, 2010, which is hereby incorporated herein by reference in its entirety.

FIELD OF THE INVENTION

The present invention relates in general to the field of burial caskets, and in particular, to latches or latch mechanisms for use with burial caskets.

BACKGROUND OF THE INVENTION

Burial caskets typically include a bottom wall and a plurality of upstanding side walls, with a hinged lid attached to at least one of the side walls and movable to a closed position. A latch mechanism is typically used to hold the hinged lid in a closed position.

SUMMARY OF THE INVENTION

The present invention provides a secure, light weight, low parts-count latching assembly for a casket lid, which also provides enhanced structural rigidity for the casket. The latching assembly includes a latch housing and movable inner latch member that are typically disposed in a side wall of a casket, and a pin that is typically disposed in the casket lid. When the casket lid is fully closed, the pin is positioned in bores or through-holes of the latch housing and inner latch member, and the inner latch member moves to engage the pin, thereby retaining the lid in its closed position. When the inner latch member is moved to a disengaging position, the inner latch member disengages the pin so that the pin can be removed from the latch housing by opening the casket lid.

According to one form of the present invention, a pin latch assembly or mechanism includes a latch housing and a movable inner latch member, both of which receive a pin member that is retained by the inner latch member. The inner latch member is disposed or supported at the latch housing, and both the inner latch member and the latch housing include bores or through-holes that are generally in alignment with one another for receiving the pin. The pin is sized to fit in the through-holes of the inner latch member and the latch housing, and includes a retaining element. The inner latch member is movable between an engaging position and a disengaging position, whereby a portion of the inner latch member engages and disengages the retaining element of the pin member. A biasing member is disposed in the latch housing and urges the inner latch member toward the engaging position. The force of the biasing member may be overcome to move the inner latch member to the disengaging position, to thereby disengage the retaining element of the pin member to release the pin member from the inner latch member.

In one aspect, the inner latch member includes a push-release portion having a push-surface. The latch housing defines a channel for movably receiving the push-release portion of the inner latch member. The push-surface of the push-release portion is accessible via the channel. The inner latch member is movable from the engaging position to the disengaging position by urging the push-surface of the push-release portion to overcome the biasing force of the biasing member.

In one aspect, the biasing member and the inner latch member are unitarily formed as one unit. For example, the biasing member may be a pair of leaf springs that extend from, but are formed in one piece with, a main body of the inner latch member.

In another aspect, the portion of the inner latch member that engages the retaining element at least partially defines the through-hole of the inner latch member.

In yet another aspect, the retaining element of the pin member is a recess in the pin member. The recess is configured to receive the portion of the inner latch member.

In still another aspect, the pin latch assembly may be used in combination with a casket having side walls and a hinged lid. One of the pin member and the latch housing is disposed at one of the side wall and the hinged lid, while the other of the pin member and the latch housing is disposed at the other of the side wall and the hinged lid.

According to another form of the present invention, a casket includes first and second opposite side walls, a lid that is pivotable between an open position and a closed position, at least one hinge, a latch housing, an inner latch member, a pin member, and a biasing member at the latch housing. The lid is coupled to the first side wall of the casket via at least one hinge. The latch housing is disposed at one of the second side wall and the lid of the casket, and defines a through-hole for receiving the pin member. The inner latch member is movably disposed at the latch housing, and includes a through-hole that is generally aligned with the through-hole of the latch housing, where the through-hole of the inner latch member is also configured to receive the pin member. The pin member is disposed at the other of the second side wall and the lid of the casket, across from the hinge, and is aligned so that when the lid is in its closed position, the pin is aligned with the through-holes of the inner latch member and the latch housing. The pin member is sized to fit in the through-holes, and includes a recess for engagement by a portion of the inner latch member. The inner latch member is movable between a recess-engaging position and a recess-disengaging position. The biasing member is configured to urge the inner latch member toward the recess-engaging position. When the lid is pivoted to the closed position, the pin member is disposed in the through-holes of the inner latch member and the latch housing, and the inner latch member is biased to the recess-engaging position so that a portion of the inner latch member is received in the recess of the pin member, thereby retaining the pin member at the inner latch member and retaining the lid in the closed position.

According to one aspect, the second side wall of the casket includes or defines a passageway that is generally aligned with a push-release portion of the inner latch member so that a tool can be inserted into the passageway to engage the push-surface and urge the inner latch member against the biasing force of the biasing member, to thereby move the inner latch member to the recess-disengaging position. With the inner latch member in the recess-disengaging position, the lid is no longer retained in the closed position by the inner latch member, and the lid can be moved to the open position.

According to another aspect, the casket includes a compressible gasket disposed between the lid and at least one of the first and second opposite side walls. The gasket is compressed between the lid and the first and/or second side walls when the lid is in the closed position.

According to still another aspect, the lid is a two-piece lid having a head end portion and a foot end portion, each end portion having at least one hinge coupling it to the casket's first side wall.

According to a further aspect, at least two each of the latch housings, the inner latch members, and the pin members are associated with each of the head end portion and foot end portion of the lid to individually retain the lid portions in their respective closed positions.

Thus, the pin latch assembly and associated casket provides secure latching of a casket lid, using minimal parts, with an unobtrusive release mechanism that can be actuated from outside the casket to release the latch mechanism and open the casket lid. The use of one or more pin latch assemblies and one or more hinges for retaining a casket lid also provides enhanced structural rigidity for the casket, particularly when the casket lid is closed and secured.

These and other objects, advantages, purposes, and features of the present invention will become apparent upon review of the following specification in conjunction with the drawings.

DESCRIPTION OF THE PREFERRED EMBODIMENTS

The present invention is directed to a pin latch assembly for retaining a casket lid in a closed position. The pin latch assembly is inexpensive to manufacture, is lightweight, can enhance the structural rigidity of a casket, and can be manufactured using relatively few parts. The pin latch assembly may be substantially hidden from view, with portions disposed in a side wall of a casket. Discreet access may be provided to a releasing feature of the latch assembly through the outer wall of the casket.

Figure 1:
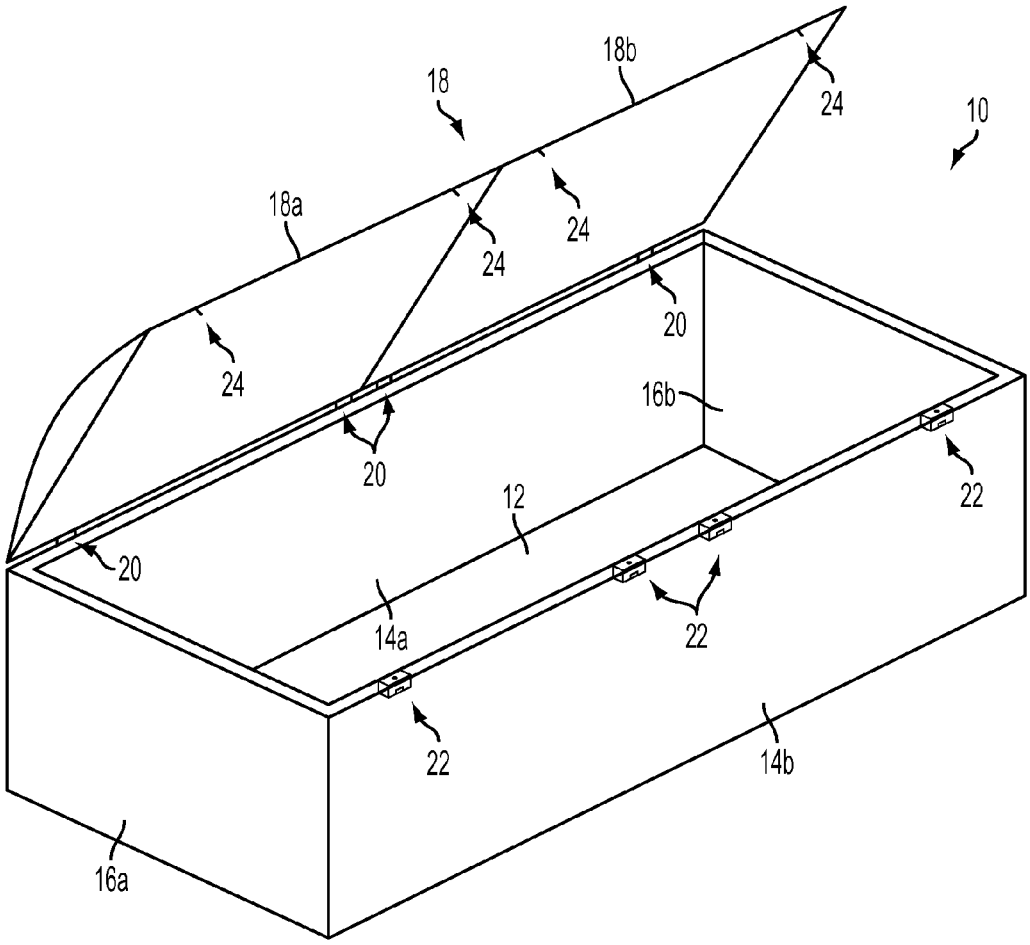
FIG. 1 is a perspective view of a casket with its hinged lid in an open position and including four pin latch assemblies in accordance with the present invention.
Figure 2:
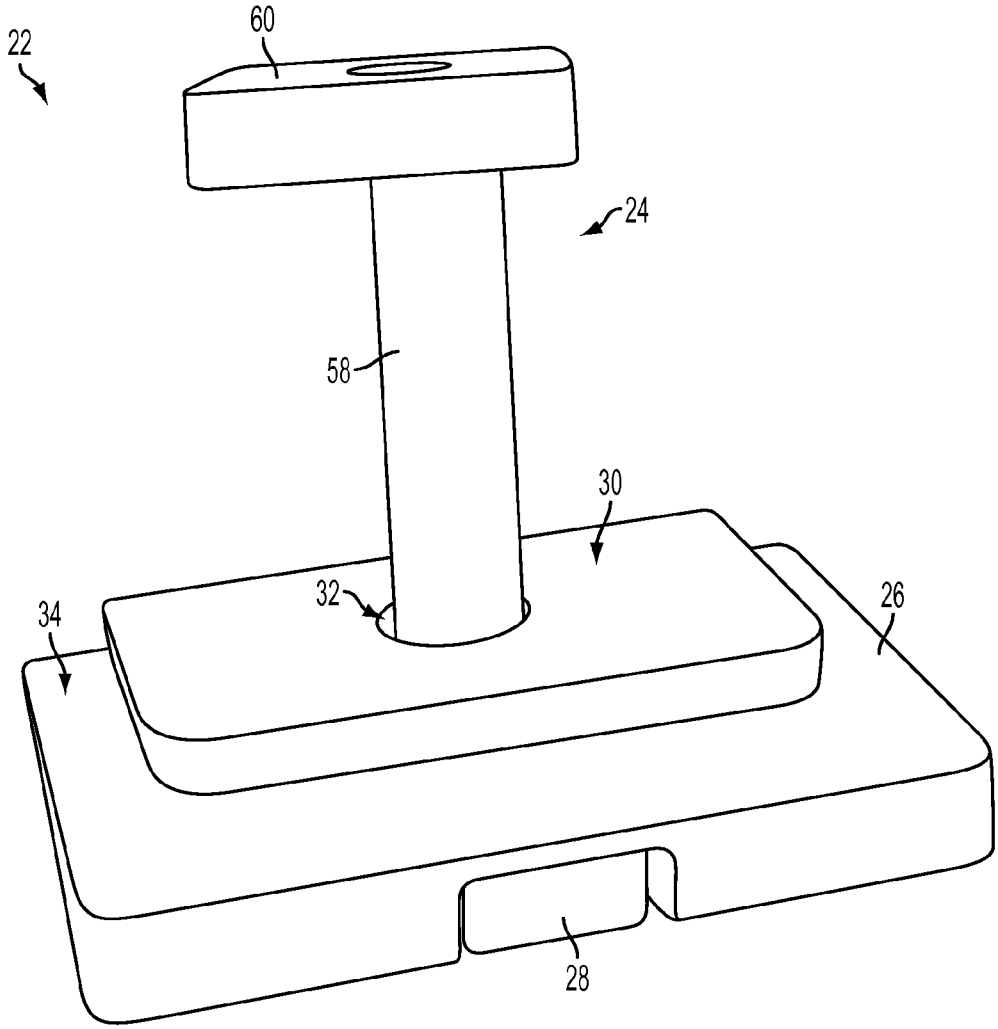
FIG. 2 is an enlarged perspective view of one of the pin latch assemblies of the casket of FIG. 1.
Figure 3A:
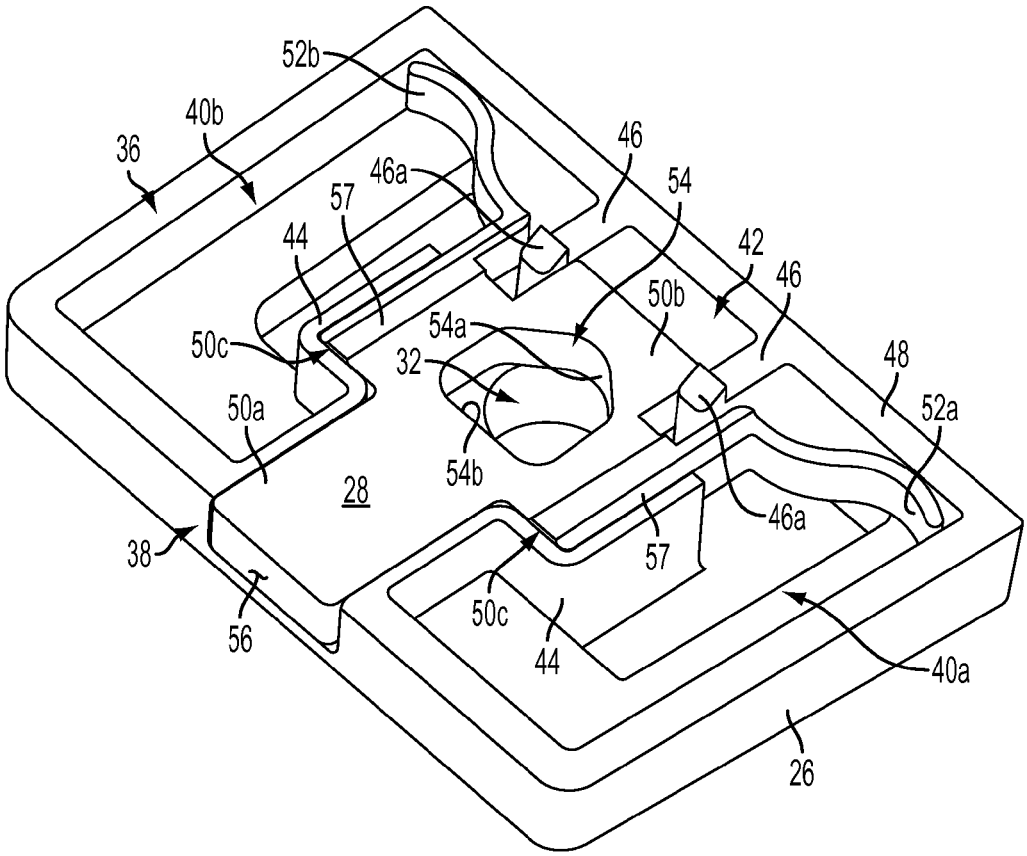
FIG. 3A is a perspective view of the underside of a latch housing and inner latch member of the pin latch assembly, with the inner latch member biased to its engaging position.
Figure 3B:
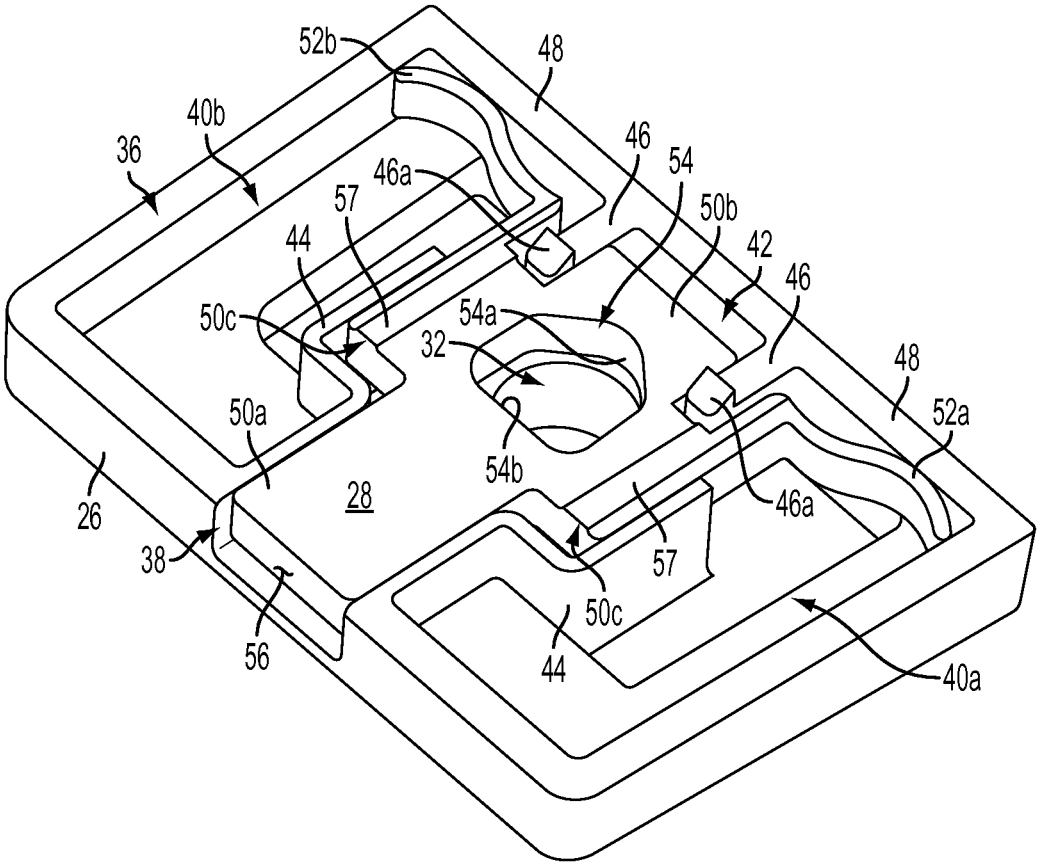
FIG. 3B is another perspective view of the latch housing and inner latch member, with the inner latch member urged to its disengaging position.
Figure 5:
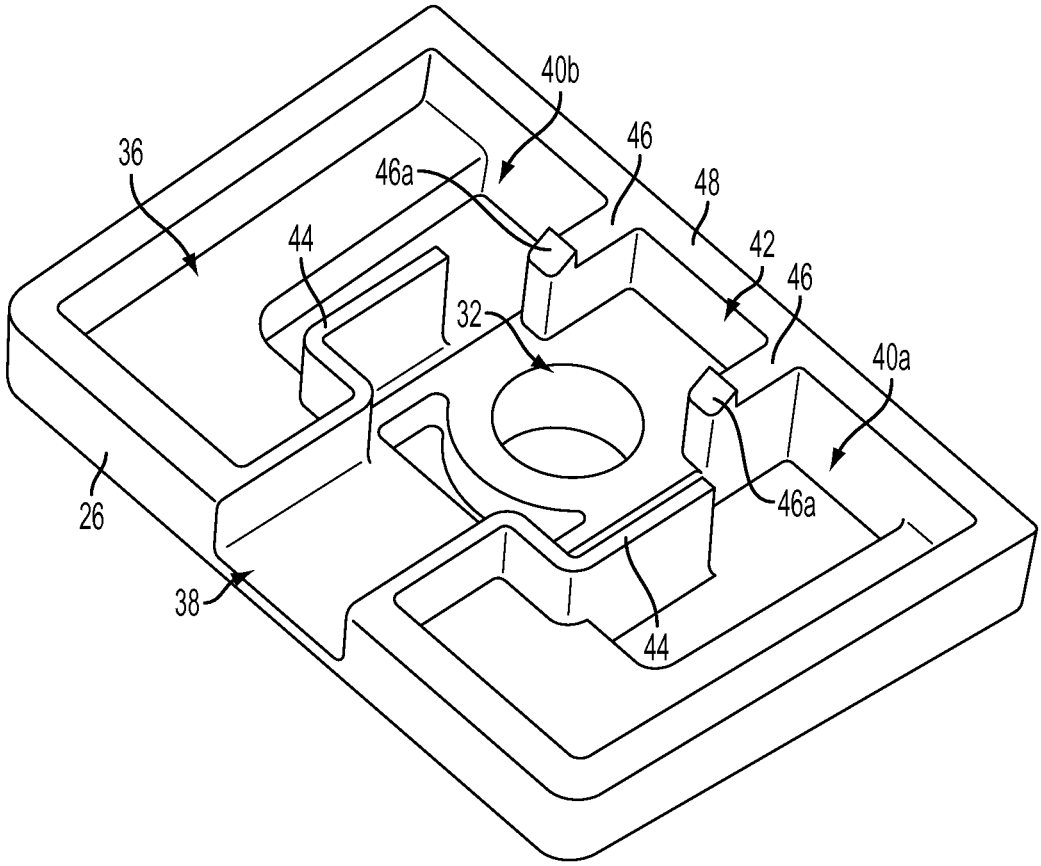
FIG. 5 is a perspective view of the underside of the latch housing with the inner latch member removed.
Figure 6:
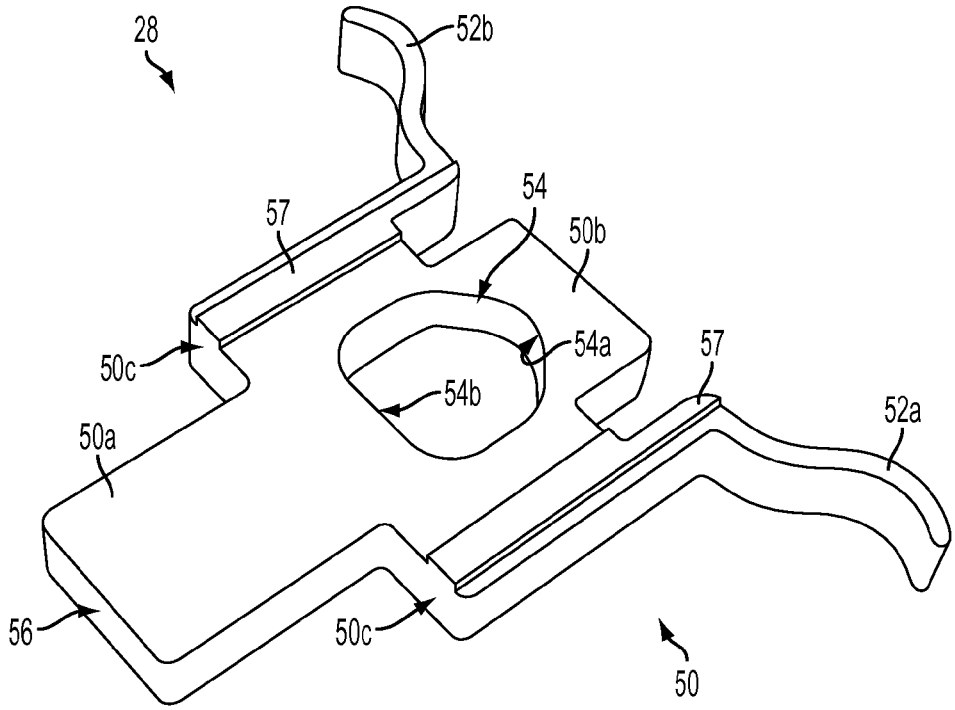
FIG. 6 is a perspective view of the inner latch member.

Referring now to FIGS. 1 and 2, a casket 10 includes a base panel 12, left and right upstanding side walls 14*a*, 14*b*, head and foot end walls 16*a*, 16*b*, and a closable lid 18. Lid 18 is pivotably attached along one side to left side wall 14*a* of casket 10 via a plurality of hinges 20, and can be releasably coupled to right side wall 14*b* by a plurality of pin latch assemblies 22, which include pin members 24 disposed in lid 18. Lid 18 is of two-piece construction and includes a head end portion 18*a* and a foot end portion 18*b*, with head end portion 18*a* being raisable and lowerable separately from, or together with, foot end portion 18*b* (FIG. 1). In addition to pin members 24, pin latch assemblies 22 include a latch housing 26 (FIGS. 2-5) and an inner latch member 28 (FIGS. 3A-3B and 6). As will be described in greater detail below, latch housing 26 and inner latch member 28 cooperate to selectively retain pin member 24 so that lid 18 may be releasably latched in a closed position.

Figure 4:
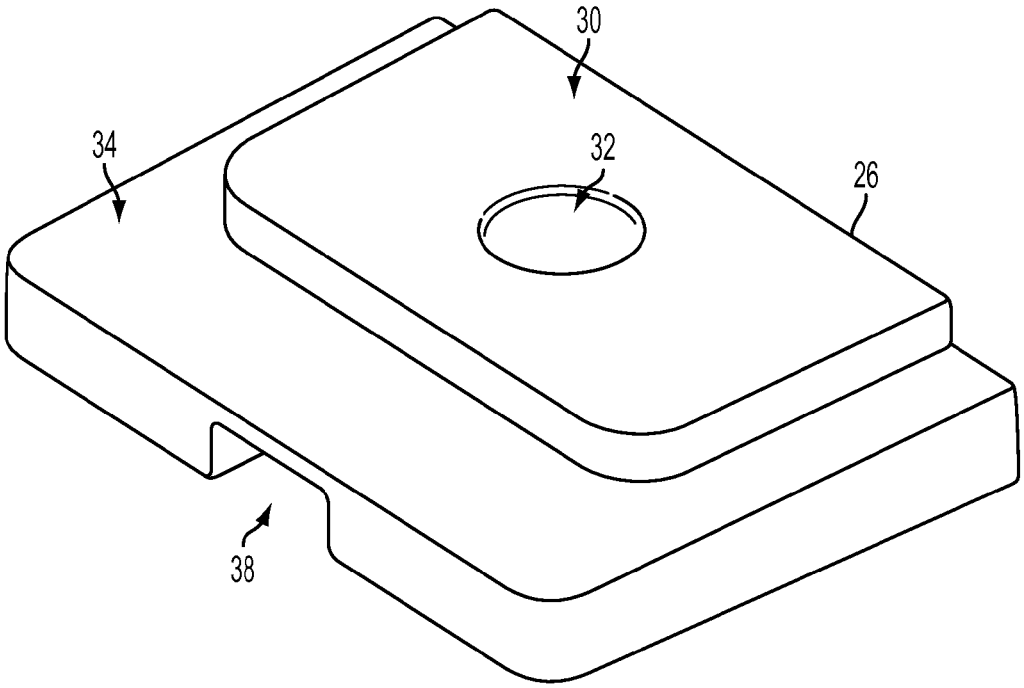
FIG. 4 is a top perspective view of the latch housing.

Latch housing 26 includes an upper surface 30 through which a bore or through-hole 32 is defined (FIGS. 2 and 4). In the illustrated embodiment, upper surface 30 is stepped above another upper surface 34, which surrounds a substantial portion of upper surface 30. The underside of latch housing 26 defines a shaped cavity or recess 36 for receiving inner latch member 28 and a portion of pin member 24 (FIGS. 3A-3B and 5). Through-hole 32 is generally circular in shape to correspond to the shape of pin member 24, and carries through from upper surface 30 to the shaped cavity 36 along the underside of the latch housing 26. Shaped cavity 36 includes a front-central cavity portion 38, left and right side cavity portions 40*a*, 40*b*, and a rear-central cavity portion 42. Front-central cavity portion 38 is separated from left and right cavity portions 40*a*, 40*b* by a pair of contoured and spaced intermediate walls 44, while rear-central cavity portion 42 is generally separated from left and right cavity portions 40*a*, 40*b* by a pair of intermediate walls 46, each including a projection 46*a* for mounting the latch housing 26. Intermediate walls 46 project forwardly from a rear wall 48 of latch housing 26, the rear wall 48 further defining portions of left and right cavity portions 40*a*, 40*b* and rear-central cavity portion 42.

Inner latch member 28 has a main body portion 50 and left and right biasing members 52*a*, 52*b* (FIGS. 3A-3B and 6). In the illustrated embodiment, biasing members 52*a*, 52*b* are unitarily or integrally formed with main body portion 50, and are thin curved elements that are resilient and flexible. However, it will be appreciated that separate biasing members, in the form of leaf springs, coil springs, and/or other resilient shapes and materials may be used without departing from the spirit and scope of the present invention. Main body 50 of inner latch member 28 includes a forward push-release portion 50*a* and a rearward push-limiter portion 50*b*, with a bore or through-hole 54 defined in main body 50 generally between forward push-release portion 50*a* and push-limiter portion 50*b*. Through-hole 54 is partially defined by an arcuate rear surface 54*a* configured to selectively engage pin member 24, and by a generally rectilinear forward surface 54*b*. Push-release portion 50*a* includes a push-surface 56 that can be used to urge the inner latch member 28 to its disengaging position, as will be described below. Longitudinally-arranged ridges 57 are formed or established on either side of through-hole 54, and may act as guides for the inner latch member 28 by engaging and sliding along respective channels formed in the upper surface of right side wall 14*b* of casket 10.

As shown in FIGS. 3A-3B, inner latch member 28 is received in the shaped cavity or recess 36 of latch housing 26, and is slidably movable within the cavity of the latch housing. Inner latch member 28 is movable between an engaging position (FIG. 3A) and a disengaging position (FIG. 3B). In both positions, inner lock member 28 is arranged with forward push-release portion 50*a* of main body 50 disposed in the front-central cavity portion 38 of latch housing 26, with push-limiter portion 50*b* generally disposed in rear-central cavity portion 42, and with left and right biasing members 52*a*, 52*b* disposed in left cavity portion 40*a* and right cavity portion 40*b*, respectively. Rear-facing curved surfaces of left and right biasing members 52*a*, 52*b* contact rear wall 48 so that the rear wall 48 serves as a reaction surface to enable the biasing members to urge the main body 50 of inner latch member 28 toward the engaging position of FIG. 3A.

Through-hole 54 of inner latch member 28 is substantially aligned with through-hole 32 of latch housing 26 when inner latch member 28 is at its disengaging position (FIG. 3B), but through-hole 54 is somewhat misaligned with the latch housing through-hole 32 when inner latch member 28 is in the engaging position of FIG. 3A. Thus, with inner latch member 28 in the engaging position, the curved rear surface 54*a* that partially defines through-hole 54 is offset from the circumferential edge of through-hole 32 and at least partially blocks or obscures a portion of latch housing through-hole 32. Push-limiter portion 50*b* of inner latch member 28 may limit the extent to which the inner latch member may be urged in the direction of the disengaging position by contacting rear wall 48 of latch housing 26, such as to prevent forward surface 54*b* at through-hole 54 of inner latch member 28 from engaging pin member 24. Main body 50 includes a pair of shoulders 50*c* (FIGS. 3A, 3B and 6) that contact respective lateral portions 44*a* of contoured intermediate walls 44 of latch housing 26 in the engaging position to limit the travel of inner latch member 28 in the direction of the engaging position, such as shown in FIG. 3A.

Figure 7:
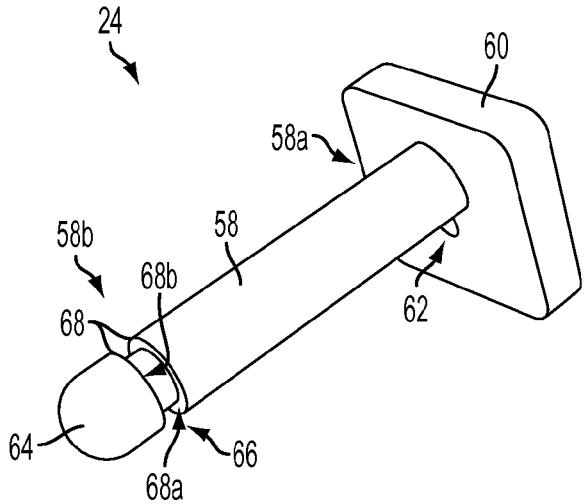
FIG. 7 is a perspective view of the pin member.

Pin member 24 includes a generally cylindrical shaft 58 having a proximal end portion 58*a* and a distal end portion 58*b*. Pin member 24 further includes a mounting portion 60 at proximal end portion 58*a* of cylindrical shaft 58. Mounting portion 60 facilitates mounting of the pin member 24 to the casket lid 18. Optionally, mounting portion 60 includes a bore 62 (FIG. 7) for receiving a fastener (not shown) that engages casket lid 18 to attach pin member 24 to the casket lid 18. Distal end portion 58*b* of cylindrical shaft 58 includes a hemispherical or "bullet-nose" tip 64 and a retaining element in the form of a circumferential notch or recess 66 extending around the full circumference of cylindrical shaft 58. Notch or recess 66 is defined between two spaced steps or neck-down portions 68 with proximal and distal surfaces 68*a*, 68*b* that are generally perpendicular to the longitudinal axis of shaft 58. However, it will be appreciated that other retaining elements are envisioned, such as non-circumferential notches, protrusions, radial bores, and the like, without departing from the spirit and scope of the present invention.

Proximal end portion 58*a* of cylindrical shaft 58 of pin member 24 is insertable through the latch housing through-hole 32 and the through-hole 54 of inner latch member 28 to provide locking engagement of inner latch member 28 with pin member 24. As the hemispherical tip 64 of cylindrical shaft 58 approaches the through-hole 54 of inner latch member 28, the tip 64 initially contacts an upper corner or edge of curved rear surface 54*a* of through-hole 54, whereby further insertion of the cylindrical shaft 58 causes main body 50 of inner latch member 28 to move rearwardly from the engaging position of FIG. 3A to the disengaging position of FIG. 3B as the hemispherical tip 64 of cylindrical shaft 58 slides along curved rear surface 54*a* of inner latch member 28 in a camming action. This movement of the main body 50 of inner latch member 28 is accomplished against the biasing force of left and right biasing members 52*a*, 52*b*. Once the curved rear surface 54*a* defining through-hole 54 is generally aligned with the notch or recess 66 of cylindrical shaft 58, main body 50 is biased back toward its engaging position by biasing members 52*a*, 52*b*, whereby curved rear surface 54*a* is received in a portion of notch 66 of cylindrical shaft 58.

Because the distal stepped surface 68*b* of cylindrical shaft 58 is substantially perpendicular to the longitudinal axis of the shaft, the neck-down portion 68*a* causes shaft 58 to be retained at inner latch member 28 via the engagement of a portion of inner latch member 28 (the portion being near curved rear surface 54*a*) with distal stepped surface 68*b*. Cylindrical shaft 58 is thereby securely retained so that inner latch member 28 generally must be urged to its disengaging position, against the biasing force of biasing members 52*a*, 52*b*, in order to release cylindrical shaft 58.

It will be appreciated that, depending on the hardness or resilience of the materials used for pin member 24 and inner latch member 28, the ability of inner latch member 28 to retain the pin member 24 may be overcome without first urging the inner latch member 28 to its disengaging position, by applying sufficient opening or extraction force to the pin member 24. For example, if relatively soft materials are used, the engaging portions of pin member 24 and inner latch member 28 may deflect upon application of a sufficiently large force, while harder materials would reduce or substantially limit deflections and thus increase the force needed to forcibly release the pin member 24 from engagement with the inner latch member. The perpendicularity of the distal stepped surface 68*b* that partially defines notch or recess 66 in cylindrical shaft 58 can also affect the retention of pin member 24 at inner latch member 28. For example, providing a ramped neck-down portion that gradually transitions from the diameter of shaft 58 to the diameter of notch 66, would result in a reduced or lesser opening force being applied to cylindrical shaft 58 to urge inner latch member 28 to the disengaging position and release pin member 24, as compared to when surface 68*b* is made perpendicular to the axis of shaft 58.

Pin latch assemblies 22 may be made from substantially any materials that are sufficiently strong, hard and/or resilient, and wear-resistant, and may preferably be light in weight and low in cost. For example, although metals may be used for the components of the pin latch assemblies 22, polymeric materials may be particularly well-suited, as they are generally light in weight and readily formed by molding and/or machining at relatively low cost. For example, acrylonitrile butadiene styrene (ABS) resin may be used to form pin member 24 and latch housing 26, while inner latch member 28 may be formed of acetal plastic resin, which is both strong and relatively hard, while exhibiting excellent fatigue life for the flexing of biasing members 52*a*, 52*b*.

Figure 8:
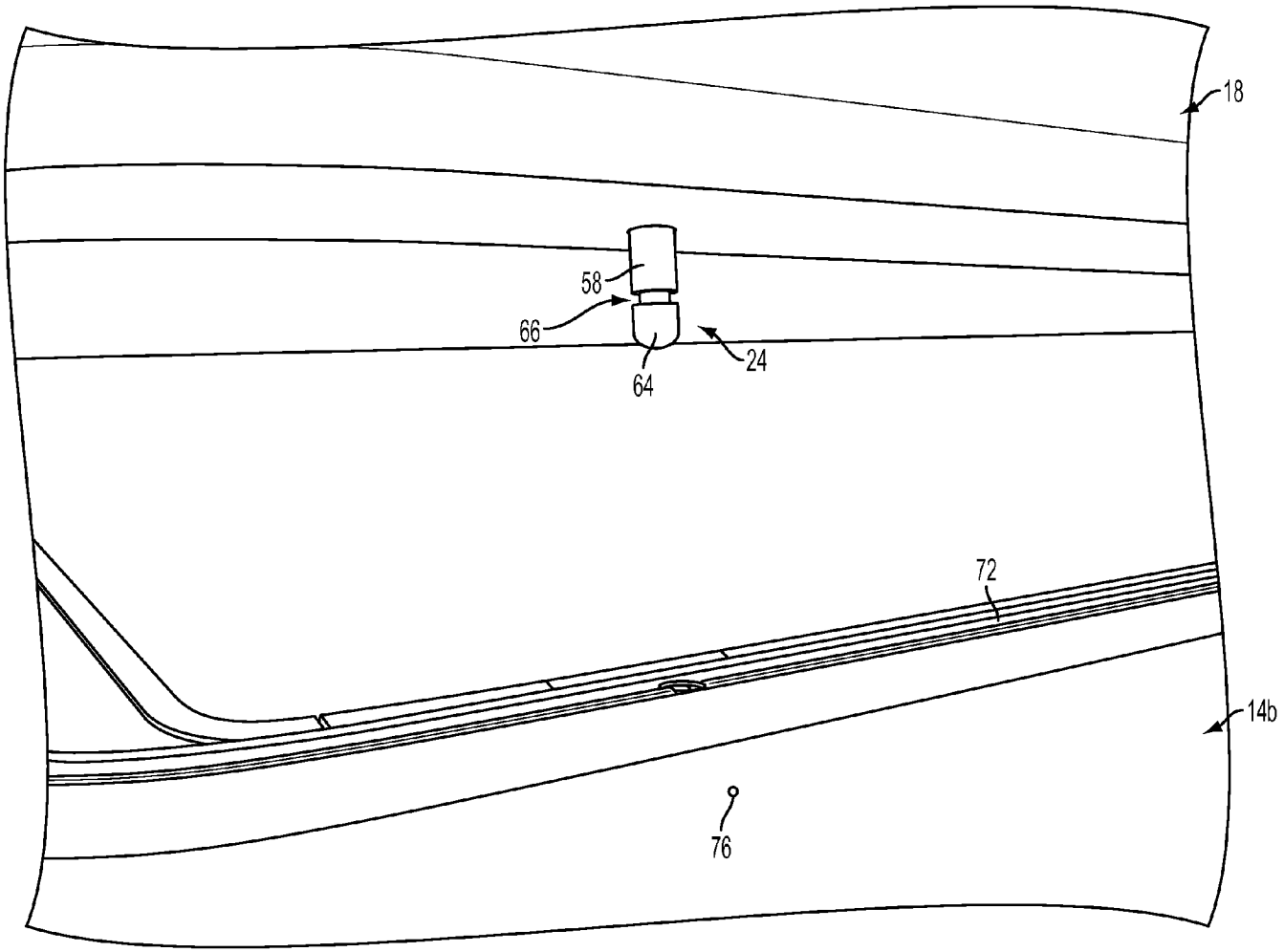
FIG. 8 is a side perspective view of a pin member projecting from the lid of a casket and aligned with the through-holes of the latch housing and inner latch member in the casket side wall.
Figure 9:
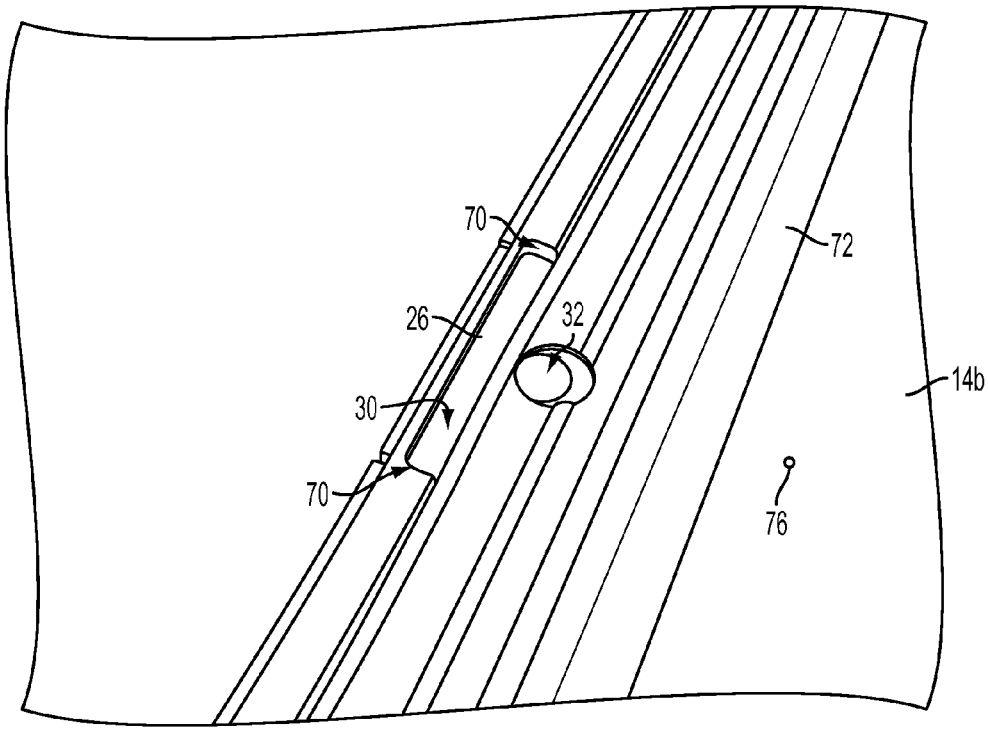
FIG. 9 is a top perspective view of the latch housing and inner latch member positioned in the side wall of the casket.

As best seen in FIGS. 1 and 9, latch housing 26 and inner latch member 28 may be installed in the upper end portion of right side wall 14*b* of casket 10, such as in a cavity or recess 70 made for that purpose (FIG. 9). Pin member 24 is secured to lid 18 so that a portion of cylindrical shaft 58, including distal end portion 58*b*, projects downwardly from a lower edge portion of the lid 18, such as shown in FIG. 8, with mounting portion 60 used to secure pin member 24 inside of lid 18. Cylindrical shaft 58 protrudes sufficiently so that notch or recess 66 is aligned with inner latch member 28 when lid 18 is fully closed.

Optionally, casket 10 includes a resilient gasket 72 (FIGS. 8 and 9) that is disposed along upper surfaces of the left and right side walls 14*a*, 14*b* and the head and foot end walls 16*a*, 16*b*. Gasket 72 is compressible between lid 18 and the upstanding walls of the casket 10 in order to generally seal the casket when lid 18 is closed. Gasket 72 includes bores or through-holes 74 that are generally aligned with the respective through-holes of latch housing 26 and inner latch member 28, so that the cylindrical shaft 58 of pin member 24 first passes through the through-hole 74 of gasket 72 prior to entering the respective through-holes of latch housing 26 and inner latch member 28. By securing casket lid 18 to the casket side walls 14*a*, 14*b* with latch assemblies 22 and hinges 20, the structural rigidity of casket 10 is enhanced when lid 18 is closed and latched, by combining the strength of lid 18 with that of the side walls 14*a*, 14*b*, end walls 16*a*, 16*b*, and bottom panel 12. This enhanced structural rigidity may be particularly beneficial when the casket is a light weight and/or modular casket, such as the casket described below with reference to FIGS. 10 and 11 and/or the modular casket of commonly-assigned and co-pending U.S. patent application Ser. No. 13/086,069, filed Apr. 13, 2011 (now U.S. Pat. No. 8,291,556), which is hereby incorporated herein by reference in its entirety.

The inner latch member 28 and latch housing 26 are received in cavity or recess 70 and substantially hidden from view by at least the outermost surface of right side wall 14*b* of casket 10. As shown in FIGS. 8 and 9, a bore or passageway 76 is provided in the outer surface of right side wall 14*b* of casket 10, and is generally aligned with the front push-surface 56 of forward push-release portion 50 of inner latch member 28. Passageway 76 provides access to front push-surface 56 of inner latch member 28, through the outer surface of right side wall 14*b*, to permit a user to move the inner latch member 28 from the engaging position to the disengaging position by inserting a small tool, such as a pin or shaft, through the passage 76. The tool can be used to push against the push-surface 56 to move the inner latch member to its disengaging position. Thus, latch housing 26 and inner latch member 28 may be hidden from view, in the recess 70 of right side wall 14*b*, while leaving the push-surface 56 of inner latch member 28 accessible using a tool. Passage 76 may be particularly small and unobtrusive so that the finished casket has a clean appearance without obvious latch or release mechanisms, while still providing a secure and readily-releasable latch mechanism.

Figure 10:
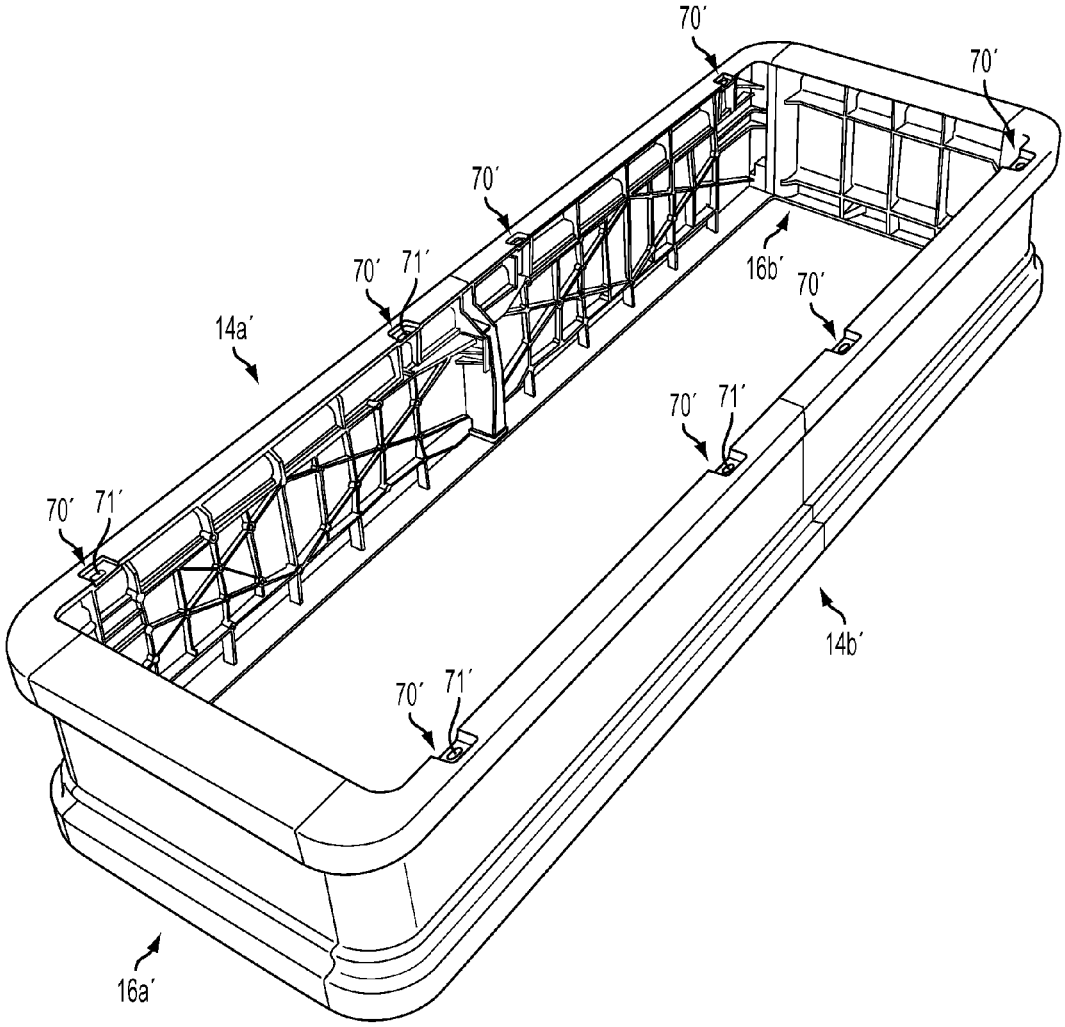
FIG. 10 is a top perspective view of a portion of a modular casket assembly configured for use with the latch assemblies of the present invention.
Figure 11:
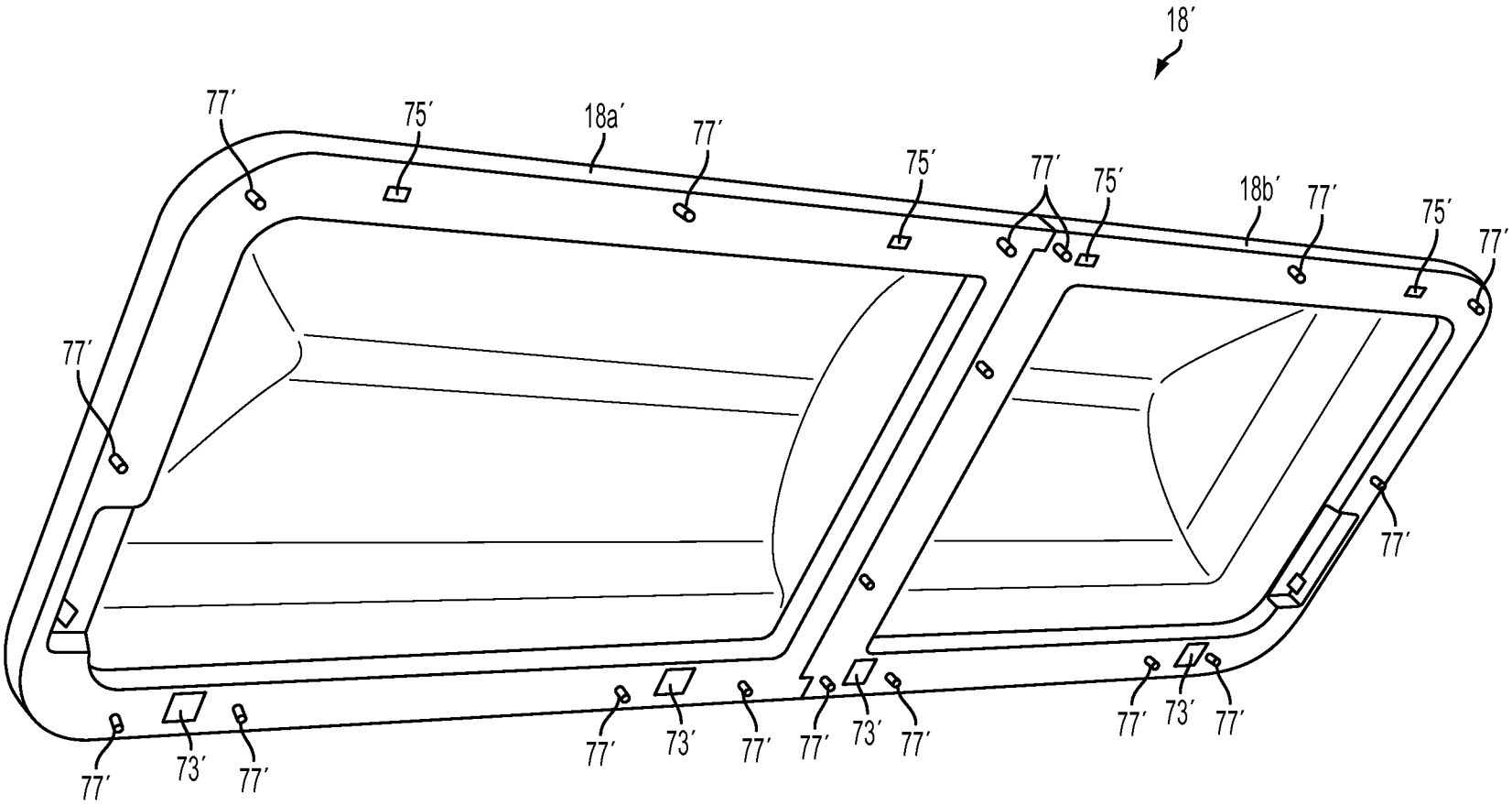
FIG. 11 is a bottom perspective view of a casket lid for use with the modular casket assembly of FIG. 10.
Figure 12:
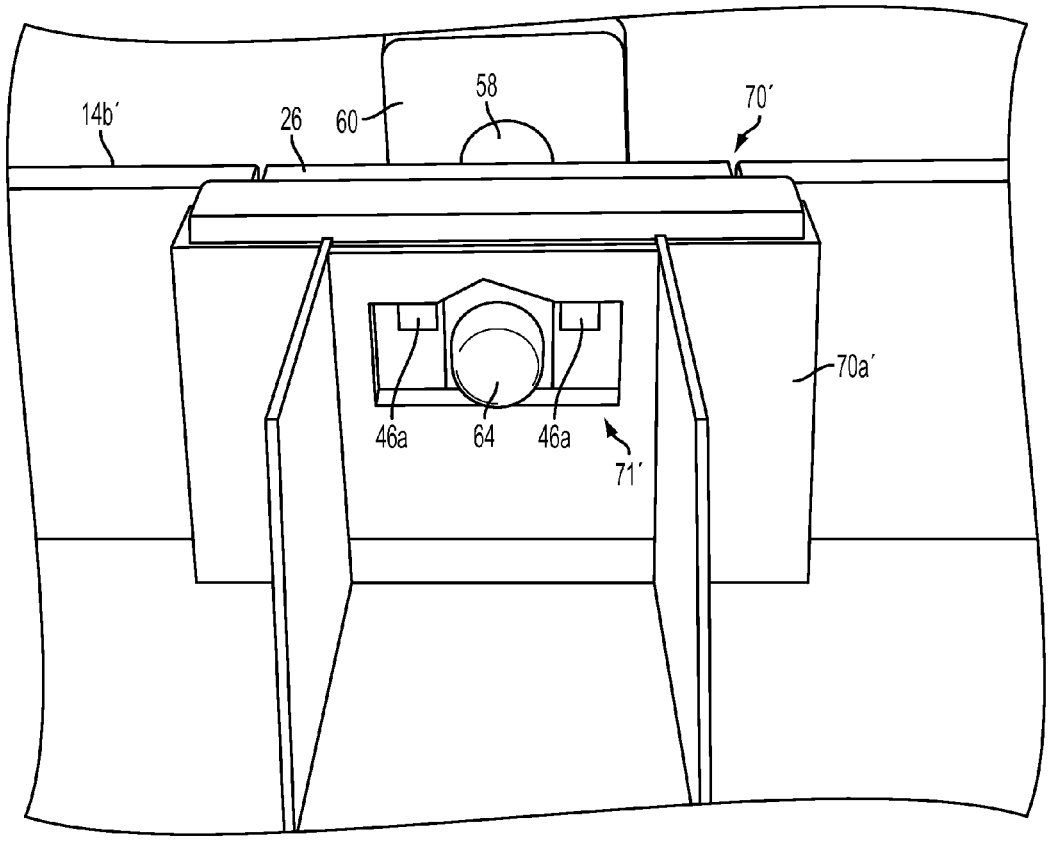
FIG. 12 is an enlarged bottom perspective view of a recess in a side wall of the modular casket assembly of FIG. 10, having a latch assembly installed, and viewed from the inside of the side wall.

Optionally, the pin latch assemblies of the present invention may be installed in a light weight modular casket having left and right upstanding side walls 14*a*', 14*b*', head and foot end walls 16*a*', 16*b*', and a two-piece closable lid 18' (FIGS. 10 and 11). Each side wall 14*a*', 14*b*' may be of two-piece construction and joined to separate head and foot end walls 16*a*', 16*b*', all made of light weight molded polymeric materials, such as shown and described in previously-incorporated U.S. patent application Ser. No. 13/086,069 (U.S. Pat. No. 8,291,556). Side walls 14*a*', 14*b*' each include a total of four cavities or recesses 70' for receiving either hinges or pin latch assemblies (FIG. 10). In the illustrated embodiment, recesses 70' of left side wall 14*a*' are substantially identical to the recesses 70' of right side wall 14*b*' so that left and right side walls are interchangeable, and the hinges and pin latch assemblies can have similar or substantially identical mounting surfaces as one another. As shown in FIG. 12, each recess 70' includes a bottom surface 70*a*' having a through-hole 71' configured to receive projections 46*a* of latch housing 26 (FIG. 12), which aid in securing each latch housing 26 at a respective recess 70'.

Two-piece lid 18' includes a head end portion 18*a*' and a foot end portion 18*b*', whereby head end portion 18*a*' is raisable and lowerable separately from foot end portion 18*b*' (FIG. 11). Optionally, the head and foot end portions may be substantially identical to one another to reduce complexity and cost. Head end portion 18*a*' and foot end portion 18*b*' each includes a pair of hinge recesses 73' and a pair of pin member recesses 75'. In addition, lid 18' includes a plurality of alignment pins 77' that are received in respective bores (not shown) along the top surfaces of side walls 14*a*', 14*b*' and head and foot end walls 16*a*', 16*b*' to resist lateral sliding movement of the lid relative to the side walls and end walls of the casket, and thereby enhance the structural rigidity of the casket when the lid 18' is closed. Once pin members 24 are installed at pin member recesses 75' and hinges 20 are installed at hinge recesses 73', an overlayment and/or gasket (not shown) may be positioned around the perimeter of lid 18' to at least partially cover or obscure the mounting portions or surfaces of the hinges 20 and pin members 24. Although side walls 14*a*', 14*b*' and lid 18' are shown and described as being configured to receive four pin latch assemblies and four hinges, it will be appreciated that more or fewer pin latch assemblies and hinges may be used, and that one or more pin latch assemblies may also be located in the head and foot end walls, without departing from the spirit and scope of the present invention.

Thus, the present invention provides a secure, lightweight, inexpensive, and readily-releasable latch mechanism or assembly for a casket, which is substantially hidden from view and securely retains the casket lid in a closed position. The pin latch assemblies allow the casket lid to be opened when necessary, but provide for security and enhanced structural rigidity of the casket when the lid is in the closed position, and facilitate sealing of the casket when a gasket is provided.

Changes and modifications in the specifically described embodiments may be carried out without departing from the principles of the present invention, which is intended to be limited only by the scope of the appended claims as interpreted according to the principles of patent law including the doctrine of equivalents.

The embodiments of the invention in which an exclusive property is claimed are defined as follows:

1. A pin latch assembly comprising:

a latch housing defining a through-hole;

an inner latch member movably disposed at said latch housing, said inner latch member having a through-hole that is generally aligned with said through-hole of said latch housing;

a pin member sized to fit in said through-holes of said inner latch member and said latch housing, said pin member having a retaining element;

said inner latch member being movable between an engaging position and a disengaging position;

a biasing member disposed at said latch housing and unitarily formed with said latch member, said biasing member configured to urge said inner latch member toward said engaging position; and wherein when said pin member is disposed in said through-holes and said inner latch member is in said engaging position, a portion of said inner latch member engages said retaining element of said pin member to retain said pin member at said inner latch member, and wherein when and said inner latch member is in said disengaging position, said inner latch member disengages said retaining element of said pin member to release said pin member from said inner latch member.

2. The pin latch assembly of claim 1, further comprising:

a push-release portion of said inner latch member, said push-release portion comprising a push-surface;

a channel defined by said latch housing and adapted to movably receive said push-release portion, wherein said push-surface of said push-release portion is accessible via said channel; and wherein said inner latch member is movable from said engaging position to said disengaging position by urging said push-surface of said push-release portion against a biasing force of said biasing member.

3. The pin latch assembly of claim 1, wherein said biasing member comprises a pair of leaf springs.

4. The pin latch assembly of claim 1, wherein said portion of said inner latch member that engages said retaining element at least partially defines said through-hole of said inner latch member.

5. The pin latch assembly of claim 1, wherein said retaining element of said pin member comprises a recess in said pin member, said recess configured to receive said portion of said inner latch member that engages said retaining element.

6. The pin latch assembly of claim 1, further in combination with a casket having side walls and a hinged lid, wherein one of said pin member and said latch housing is disposed at one of said side wall and said hinged lid, and wherein the other of said pin member and said latch housing is disposed at the other of said side wall and said hinged lid.

7. A casket having a lid latching assembly, comprising:

first and second opposed side walls;

a lid coupled to said first side wall and pivotable between an open position and a closed position;

at least one hinge for pivotably coupling said lid to said first side wall;

a latch housing at one of said second side wall and said lid, said latch housing defining a through-hole;

an inner latch member movably disposed at said latch housing, said inner latch member having a through-hole that is generally aligned with said through-hole of said latch housing, and said inner latch member comprising a push-release portion having a push-surface;

a pin member at the other of said second side wall and said lid, wherein when said lid is in said closed position, said pin is aligned with said through-holes of said inner latch member and said latch housing, said pin member being sized to fit in said through-holes of said inner latch member and said latch housing, and said pin member having a retaining element;

said inner latch member being movable between a pin-engaging position and a pin-disengaging position;

a biasing member disposed at said latch housing, said biasing member configured to urge said inner latch member toward said pin-engaging position;

wherein when said lid is pivoted to said closed position, said pin member is disposed in said through-holes and said inner latch member is in said pin-engaging position, wherein a portion of said inner latch member engages said retaining element of said pin member to retain said pin member at said inner latch member to thereby retain said lid in said closed position; and wherein said inner latch member is movable to said pin-disengaging position by urging said push-surface of said push-release portion against a biasing force of said biasing member.

8. The casket of claim 7, wherein said latch housing and said inner latch member are disposed at least partially in said second wall, and wherein said second wall comprises a passageway that is generally aligned with said push-surface of said push-release portion so that a tool can be inserted into said passageway to urge said push-surface against the biasing force of said biasing member to move said inner latch member to said pin-disengaging position whereupon said lid is no longer retained in said closed position by said inner latch member.

9. The casket of claim 8, wherein said passageway is accessible from an exterior of said casket.

10. The casket of claim 7, further comprising a compressible gasket disposed between said lid and at least one of said first and second opposed side walls, wherein said gasket is compressed between said lid and said at least one of said first and second opposed side walls when said lid is in said closed position.

11. The casket of claim 7, wherein said at least one hinge comprises at least two spaced hinges at said first side wall.

12. The casket of claim 11, wherein said lid comprises a two-piece lid having a head end piece and a foot end piece, at least one of said at least two spaced hinges being coupled to a respective one of said head end piece and said foot end piece.

13. The casket of claim 12, comprising at least two each of said latch housings, said inner latch members, and said pin members, wherein at least one of said latch housings, said inner latch members, and said pin members is associated with each of said head end piece and said foot end piece of said lid.

14. The casket of claim 7, wherein said biasing member and said inner latch member are unitarily formed.

15. The casket of claim 14, wherein said biasing member comprises a pair of leaf springs.

16. The casket of claim 7, wherein said portion of said inner latch member that engages said retaining element at least partially defines said through-hole of said inner latch member.

17. The casket of claim 7, wherein said retaining element of said pin member comprises a recess in said pin member, said recess configured to receive said portion of said inner latch member that engages said retaining element.

18. A pin latch assembly comprising:

a latch housing defining a through-hole;

an inner latch member movably disposed at said latch housing, said inner latch member having a through-hole that is generally aligned with said through-hole of said latch housing, and a push-release portion comprising a push-surface;

a channel defined by said latch housing and configured to movably receive said push-release portion of said inner latch member, wherein said push-surface of said push-release portion is accessible via said channel;

a pin member sized to fit in said through-holes of said inner latch member and said latch housing, said pin member having a retaining element;

said inner latch member being movable between an engaging position and a disengaging position;

a biasing member disposed at said latch housing, said biasing member configured to urge said inner latch member toward said engaging position, wherein said inner latch member is movable from said engaging position to said disengaging position by urging said push-surface of said push-release portion against a biasing force of said biasing member; and wherein when said pin member is disposed in said through-holes and said inner latch member is in said engaging position, a portion of said inner latch member engages said retaining element of said pin member to retain said pin member at said inner latch member, and wherein when and said inner latch member is in said disengaging position, said inner latch member disengages said retaining element of said pin member to release said pin member from said inner latch member.

19. A casket having a lid latching assembly, comprising:

first and second opposed side walls;

a lid coupled to said first side wall and pivotable between an open position and a closed position;

at least one hinge for pivotably coupling said lid to said first side wall;

a latch housing at one of said second side wall and said lid, said latch housing defining a through-hole;

an inner latch member movably disposed at said latch housing, said inner latch member having a through-hole that is generally aligned with said through-hole of said latch housing;

a pin member at the other of said second side wall and said lid, wherein when said lid is in said closed position, said pin is aligned with said through-holes of said inner latch member and said latch housing, said pin member being sized to fit in said through-holes of said inner latch member and said latch housing, and said pin member having a retaining element;

said inner latch member being movable between a pin-engaging position and a pin-disengaging position;

a biasing member disposed at said latch housing and unitarily formed with said latch member, said biasing member configured to urge said inner latch member toward said pin-engaging position; and wherein when said lid is pivoted to said closed position, said pin member is disposed in said through-holes and said inner latch member is in said pin-engaging position, wherein a portion of said inner latch member engages said retaining element of said pin member to retain said pin member at said inner latch member to thereby retain said lid in said closed position.

* * * * *